US007992386B2

(12) United States Patent
Schoell

(10) Patent No.: US 7,992,386 B2
(45) Date of Patent: Aug. 9, 2011

(54) WASTE HEAT ENGINE

(75) Inventor: Harry Schoell, Pompano Beach, FL (US)

(73) Assignee: Cyclone Power Technologies, Inc., Pompano Beach, FL (US)

( * ) Notice: Subject to any disclaimer, the term of this patent is extended or adjusted under 35 U.S.C. 154(b) by 457 days.

(21) Appl. No.: 12/291,001

(22) Filed: Nov. 3, 2008

(65) Prior Publication Data

US 2010/0107637 A1 May 6, 2010

(51) Int. Cl.
*F01B 1/00* (2006.01)

(52) U.S. Cl. ..... 60/508; 60/670

(58) Field of Classification Search ..... 60/508, 60/670

See application file for complete search history.

(56) References Cited

U.S. PATENT DOCUMENTS 6,145,482 A * 11/2000 Blount ..... 123/45 A
7,188,474 B2 * 3/2007 van de Loo ..... 60/660
7,556,014 B2 * 7/2009 Mason ..... 123/197.4
2008/0216480 A1 * 9/2008 Harmon et al. ..... 60/670

* cited by examiner

*Primary Examiner* — Hoang M Nguyen
(74) *Attorney, Agent, or Firm* — Robert M. Downey, P.A.

(57) ABSTRACT

An engine includes a radial arrangement of cylinders each having a reciprocating piston with a piston head and a connecting rod pivotally linked to the piston head at an upper end. A lower end of each connecting rod is pivotally linked to a crank disk that is rotatably mounted on a crank arm of a crankshaft. Steam intake valves at each cylinder are momentarily opened by a bearing cam roller that is moved in a circular path by rotation of the crank disk to sequentially engage spring urged cam followers on inboard ends of radially extending valve stems. Low pressure steam or gas is injected into the top of each cylinder, as the intake valves of the cylinders are opened in sequence, thereby forcing the piston in each cylinder through a power stroke to move the crank disk and turn the crankshaft. Angular displacement of each connecting rod through the return stroke of the piston urges an exhaust reed valve on the piston head to an open position, thereby releasing exhaust steam to a condenser chamber. The engine is self-starting and operates in a low pressure, low temperature range, using waste heat from an external source, such as exhaust from an internal combustion engine, burning of refuse (e.g. garbage or other solid waste material) or solar heat.

4 Claims, 14 Drawing Sheets

WASTE HEAT ENGINE

BACKGROUND OF THE INVENTION

1. Field of the Invention

This invention relates to steam engines and, more particularly, to a low pressure, low temperature self-starting steam engine that uses waste heat from an external source, and wherein the engine includes a radial arrangement of cylinders with reciprocating pistons for driving rotation of a crankshaft.

2. Discussion of the Related Art

The need to operate at higher temperatures and pressures results in considerable heat loss in conventional steam engines. And, while steam engines are typically larger in size and less efficient than internal combustion engines and diesel engines, (unless operating at high temperatures and pressures) the loss of heat in all types of engines significantly reduces engine efficiency. Accordingly, the ability to harness heat loss during engine operation is highly beneficial and can improve overall engine efficiency. Moreover, waste heat from normal engine operation, as well as other heat sources, can be used in alternative engine designs for generating power. For instance, the energy from waste heat in the operation of an internal combustion engine, refuse burner, or solar energy collector can be used in the operation of an alternative engine for operating an electric power generator.

OBJECTS AND ADVANTAGES OF THE INVENTION

Considering the foregoing, it is a primary object of the present invention to provide a steam engine that operates on low pressure, low temperature steam with the use of waste heat from an external heat source, such as an internal combustion engine, a refuse (e.g. garbage) burner, or a solar heat collector.

If is a further object of the present invention to provide a steam engine that operates on waste heat from an external heat source, and wherein the engine is self-starting.

It is still a further object of the present invention to provide a steam engine having a radial piston configuration, and wherein the engine operates on low pressure, low temperature steam, with an operating pressure of 2 psi to over 200 psi.

It is still a further object of the present invention to provide a steam engine that operates in a low temperature range of 225° F. to 600° F.

It is still a further object of the present invention to provide a steam engine that operates on waste heat from an external heat source, and wherein the engine is useful in the generation of electric power.

It is yet a further object of the present invention to provide a steam engine that operates on low pressure, low temperature steam with the use of waste heat, and wherein the engine is scalable to increase or decrease size and output as needed.

These and other objects and advantages of the present invention are more readily apparent with reference to the detailed description and accompanying drawings.

SUMMARY OF THE INVENTION

The present invention is directed to an engine that includes a radial arrangement of cylinders each having a reciprocating piston with a piston head and a connecting rod pivotally linked to the piston head at an upper end. A lower end of each connecting rod is pivotally linked to a crank disk that is rotatably fitted on a crank arm of a crankshaft. Steam intake valves at each cylinder are momentarily opened by a bearing cam roller that is moved in a circular path by rotation of the crank disk to sequentially engage spring urged cam followers on inboard ends of radially extending valve stems. Low pressure steam or gas is injected into the top of each cylinder, as the intake valves are opened in sequence, thereby forcing the piston in each cylinder through a power stroke to move the crank disk and turn the crankshaft. Angular displacement of each connecting rod through the return stroke of the piston urges an exhaust reed valve on the piston head to an open position, thereby releasing exhaust steam to a condenser chamber. The engine is self-starting and operates in a low pressure, low temperature range, using waste heat from an external source, such as exhaust from an internal combustion engine, burning of refuse (e.g. garbage or other solid waste material) or solar heat.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
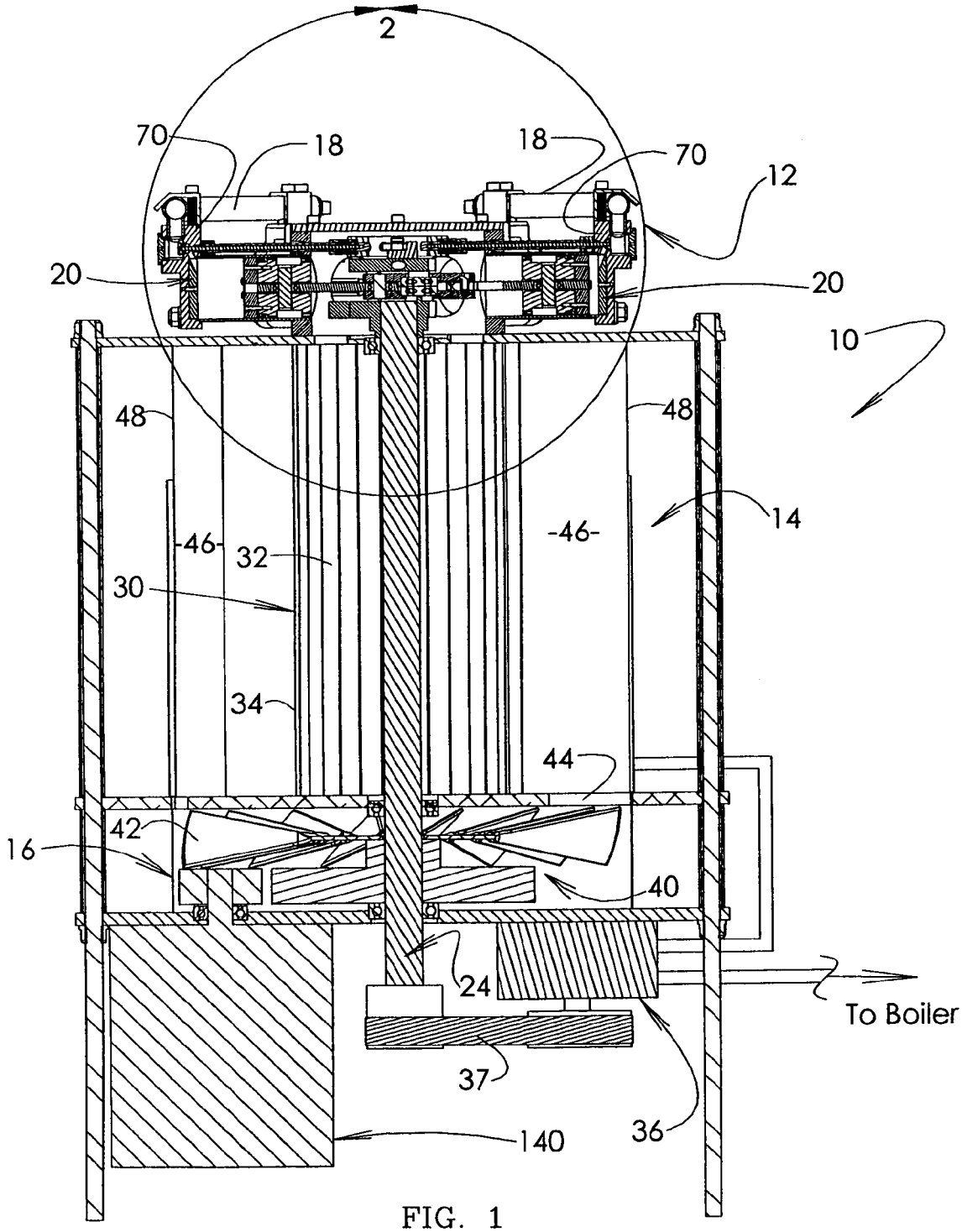
FIG. 1 is an elevational view, shown in cross-section, of the waste heat engine.
Figure 2:
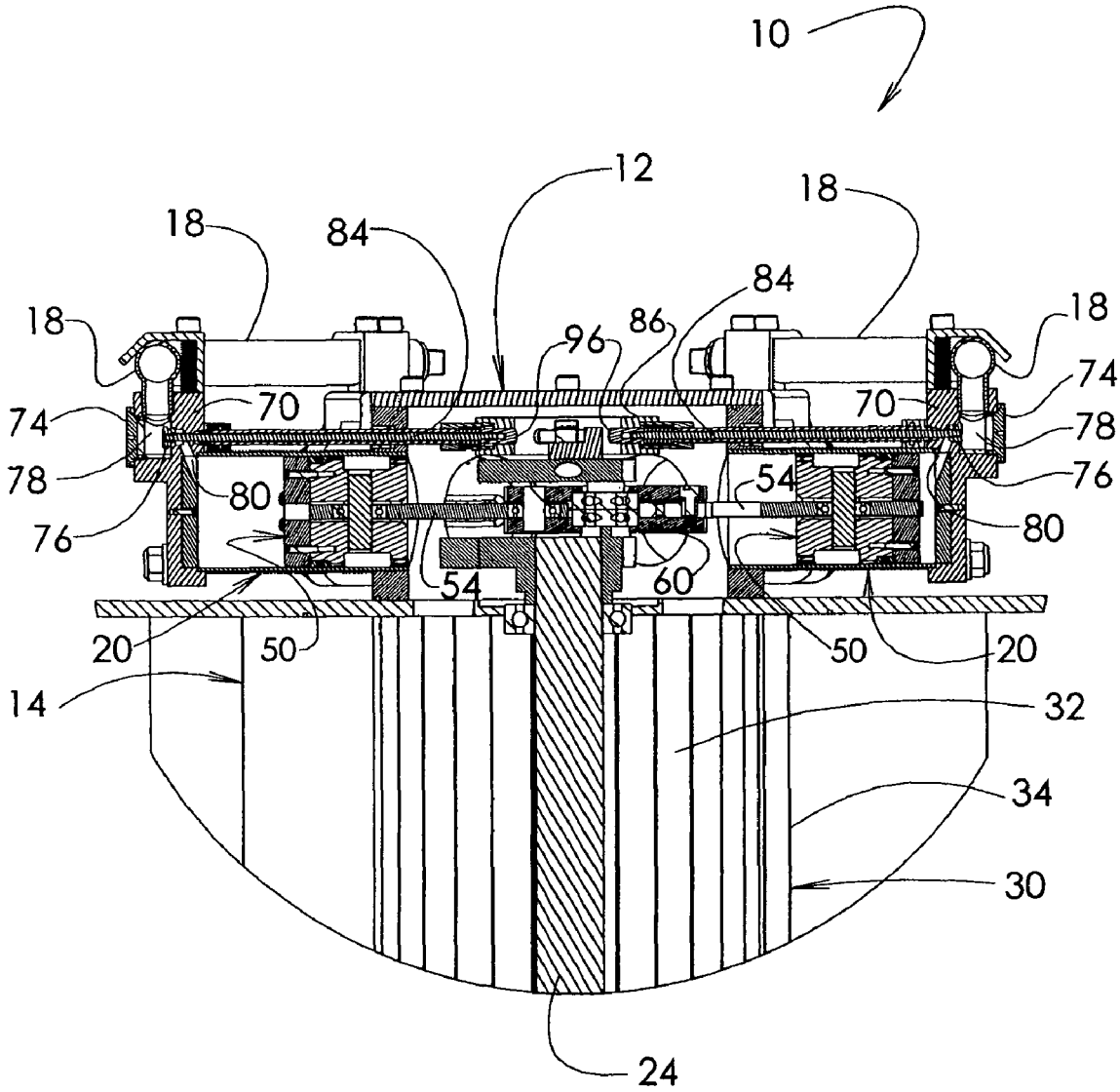
FIG. 2 is an isolated cross-sectional view taken from the area indicated as 2 in FIG. 1.
Figure 3:
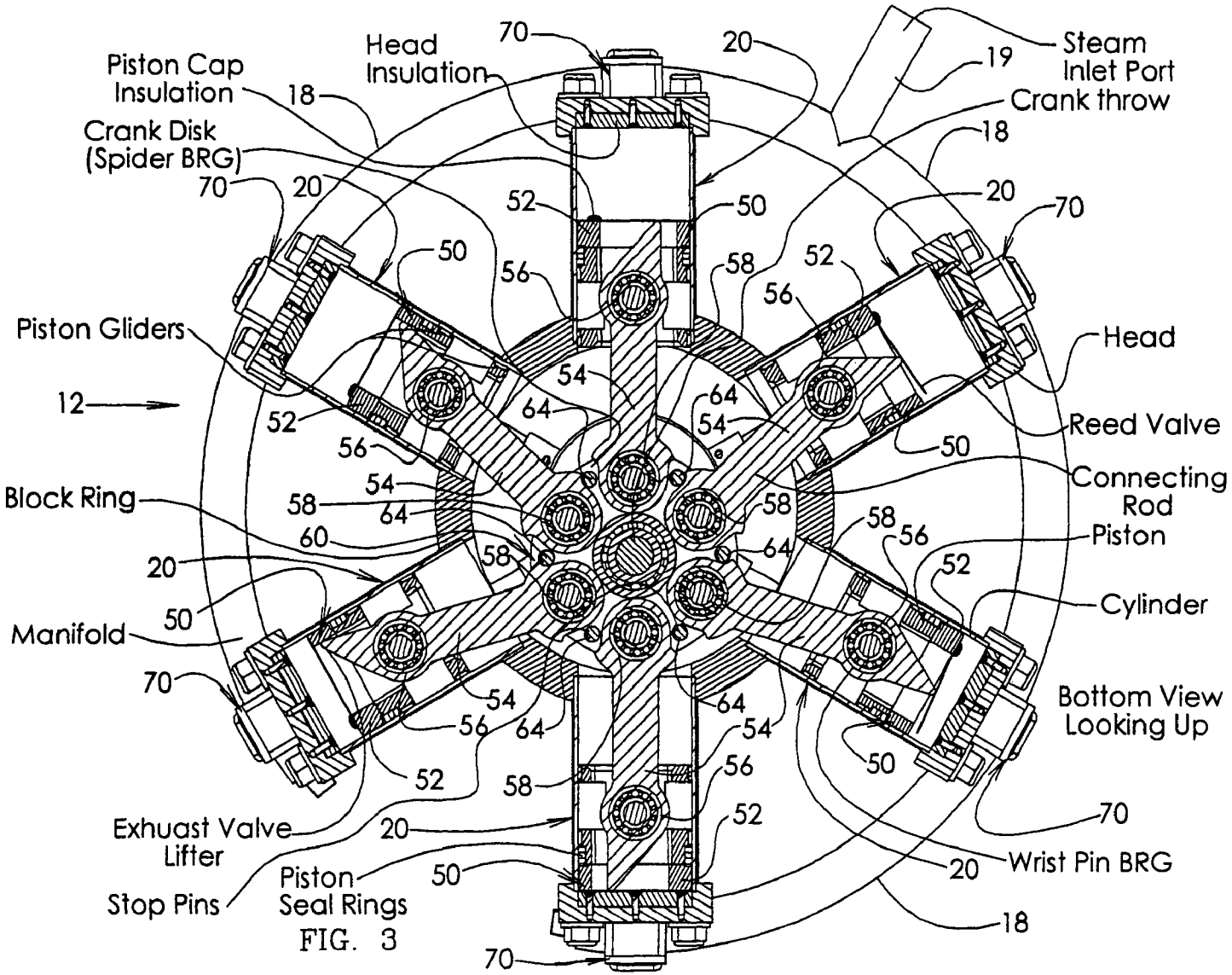
FIG. 3 is an isolated top plan view showing a spider bearing (i.e., crank disk) and a piston and cylinder arrangement of the waste heat engine.

Referring to the several views of the drawings, and initially FIGS. 1-3, the waste heat engine of the present invention is shown and is generally indicated as 10. An upper portion 12 of the engine 10 has a radial arrangement of cylinders 20. Low pressure (i.e., generally between 20 psi-200 psi), low temperature (i.e., generally between 225° F. to 600° F.) steam is generated using waste heat from an external heat source (not shown) such as an internal combustion engine, a refuse (e.g., garbage, waste material) burner, or a solar heat collector to generate seam. Water from a condenser 30 is heated in an external boiler (not shown), using the waste heat to produce steam. The low pressure, low temperature steam is directed through a main line (not shown) that connects to a steam inlet port 19 on a generally circular manifold 18 that is supported on the upper portion 12 of the engine 10. Manifold 18 is structured and disposed to equally distribute the low pressure to intake valves at each cylinder 20. A central portion 14 of the engine 10 includes the condenser 30 including a chamber 32 that is surrounded by a folded star-shaped condenser wall 34. A lower portion 16 of the engine 10 contains a blower 40 with a fan blade arrangement 42 that directs intake air up through cooling ports 44 at the bottom of the condenser. The blower is driven by rotation of the engine crankshaft 24. The cooling air passes through air transfer ducts 46 that surround the exterior of the folded wall structure 34 of the condenser 30 and exits out from blower exhaust ports 48, thereby cooling the exhaust steam within the condenser chamber 32. A fluid pump 36 on the engine is driven by rotation of the crankshaft 24 via a belt drive 37. The pump 36 returns liquid condensate collected in the bottom of the condenser chamber 32 to the steam generating source (e.g. a boiler), wherein waste heat is again used for generating the low pressure, low temperature steam used in the operation of the engine 10.

Referring to FIG. 3, each cylinder 20 in the radial arrangement includes a reciprocating piston assembly 50, including a piston head 52 that moves in a reciprocating motion within the cylinder 20 through a full piston stroke. A connecting rod 54 is pivotally linked to the piston head 52 and a central crank disk or spider bearing 60. More specifically, the connecting rod 54 of each piston assembly 50 is pivotally linked at an upper end to the piston head 52 with a wrist pin bearing 56. Similarly, a lower end of the connecting rod 54 is pivotally linked to the crank disk 60 with a wrist pin bearing 58. The crank disk 60 is eccentrically fixed to the crankshaft 24. More particularly, a crank arm on the crankshaft 24 is rotatably fitted to the center of the crank disk 60 so that the center of the crank disk 60 is offset relative to the longitudinal axis of the crankshaft 24. As steam is injected into the top of each cylinder 20 and the piston 52 is moved downwardly within the cylinder, the connecting rod 54 pivots and transmits a force on the crank disk 60 that is offset relative to the longitudinal central axis on the crankshaft 24, thereby causing the crank disk 60 to move in an orbiting motion around the central longitudinal axis of the crankshaft 24, as the crankshaft is turned. Movement on the crank disk 60 about a full orbital motion, with a complete turn of the crankshaft 24, causes the lower pivoting end of each connecting rod 54 to travel through a circular path, as indicated by the arrow in FIGS. 8A-8D. Restrictor pins 64 associated with each cylinder are fixed to the crank disk 60 and are specifically spaced and arranged relative to one another so as to abut against ears 59 on the lower end of the connecting rod 54 to limit angular deflection of each connecting rod 54.

Figure 4:
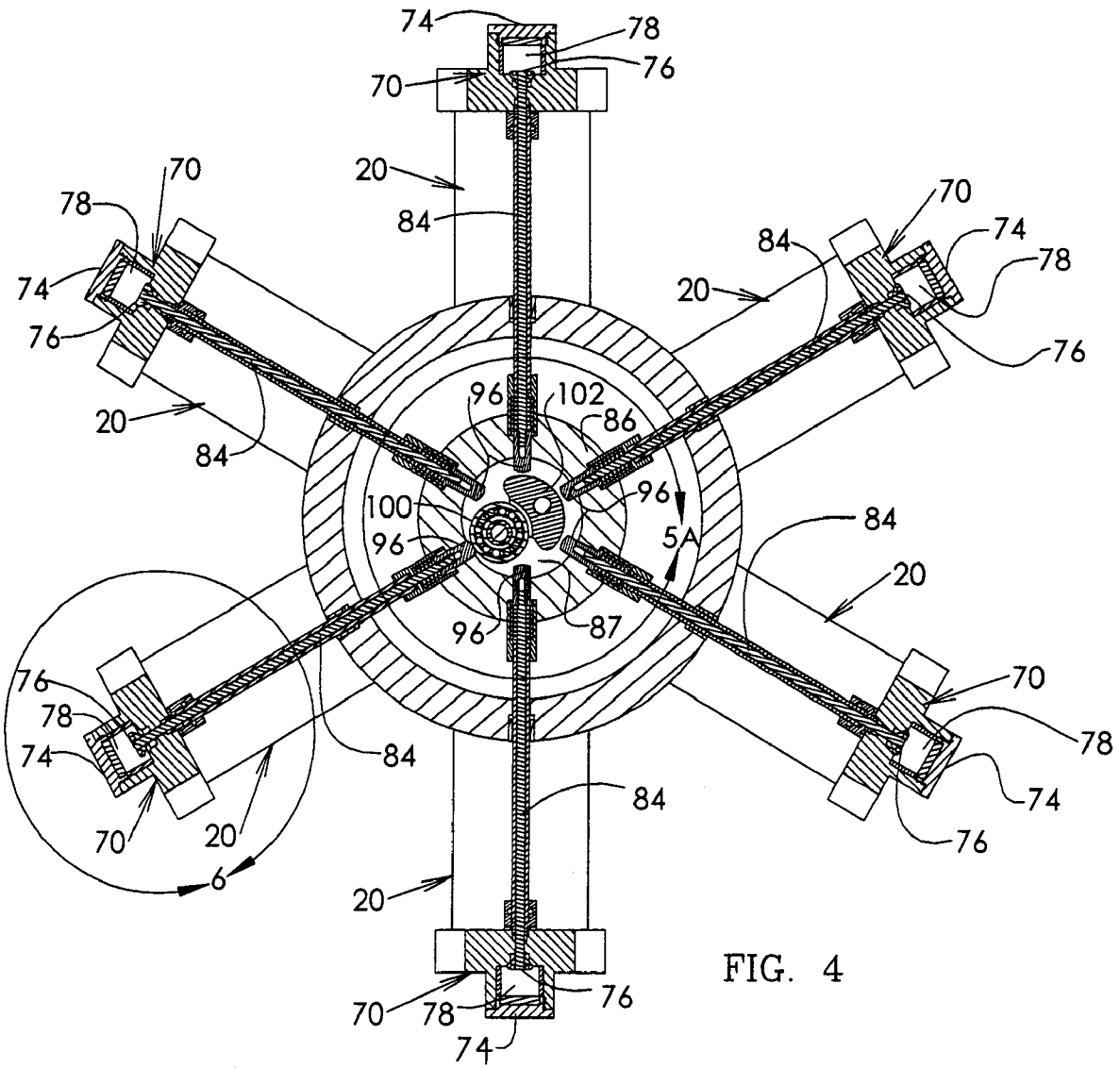
FIG. 4 is an isolated top plan view in cross-section, showing a steam intake valve and intake valve control assembly for controlling a low pressure steam or gas injection into each of the cylinders of the waste heat engine.
Figure 5A:
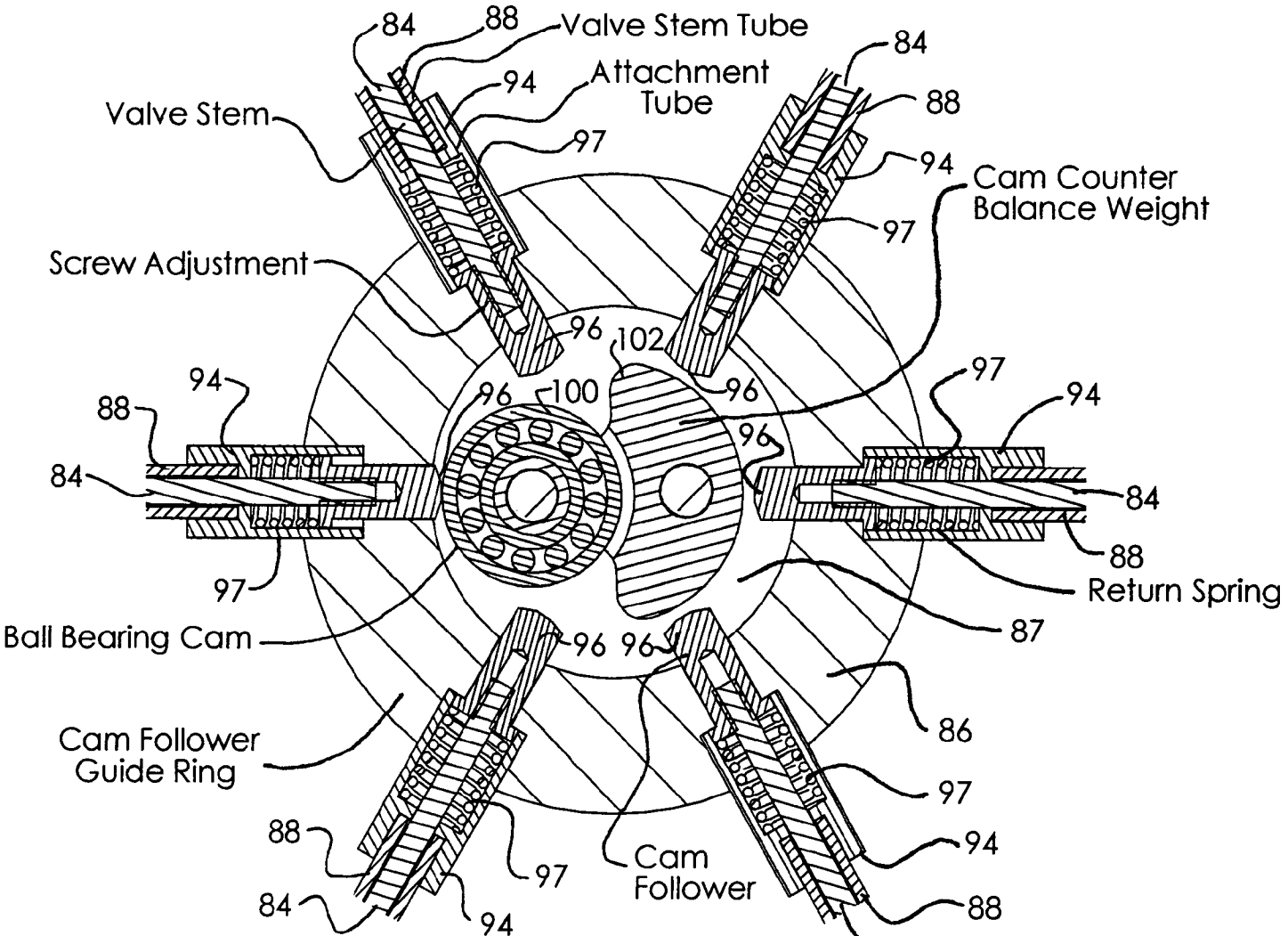
FIG. 5A is an isolated top plan view, shown in cross-section, taken from the area indicated as 5A in FIG. 4 showing a bearing cam roller positioned in contact with one cam follower on an inboard and of a valve stem, thereby urging the intake valve on the opposite end of the valve stem to an open position.
Figure 5B:
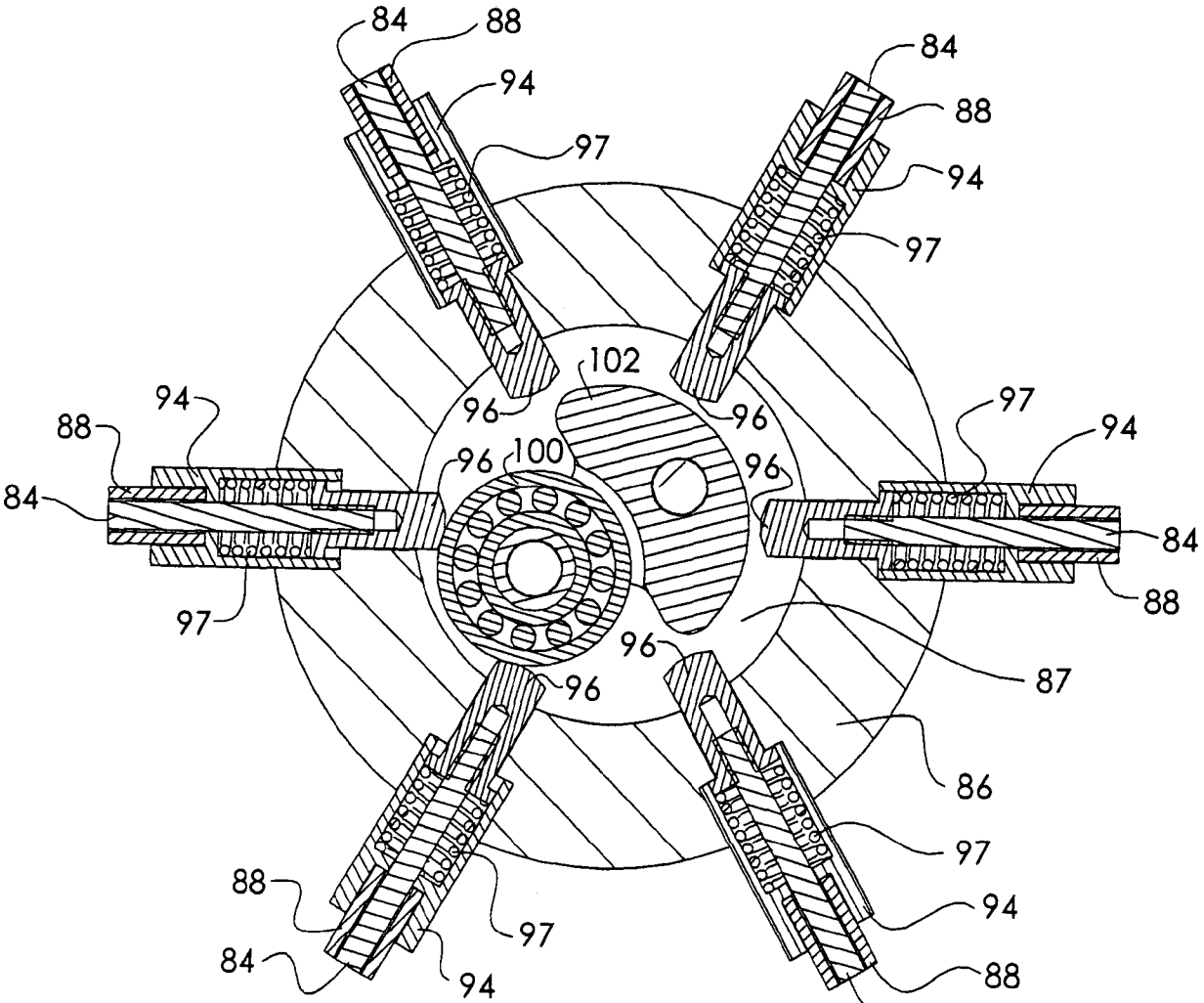
FIG. 5B is the same isolated cross-sectional view as shown in FIG. 5 A, with the bearing cam roller shown in simultaneous contact with two adjacently positioned cam followers on inboard ends of valve stems that are spaced radially about a cam follower guide ring surrounding the rotational path of the bearing cam roller.
Figure 6:
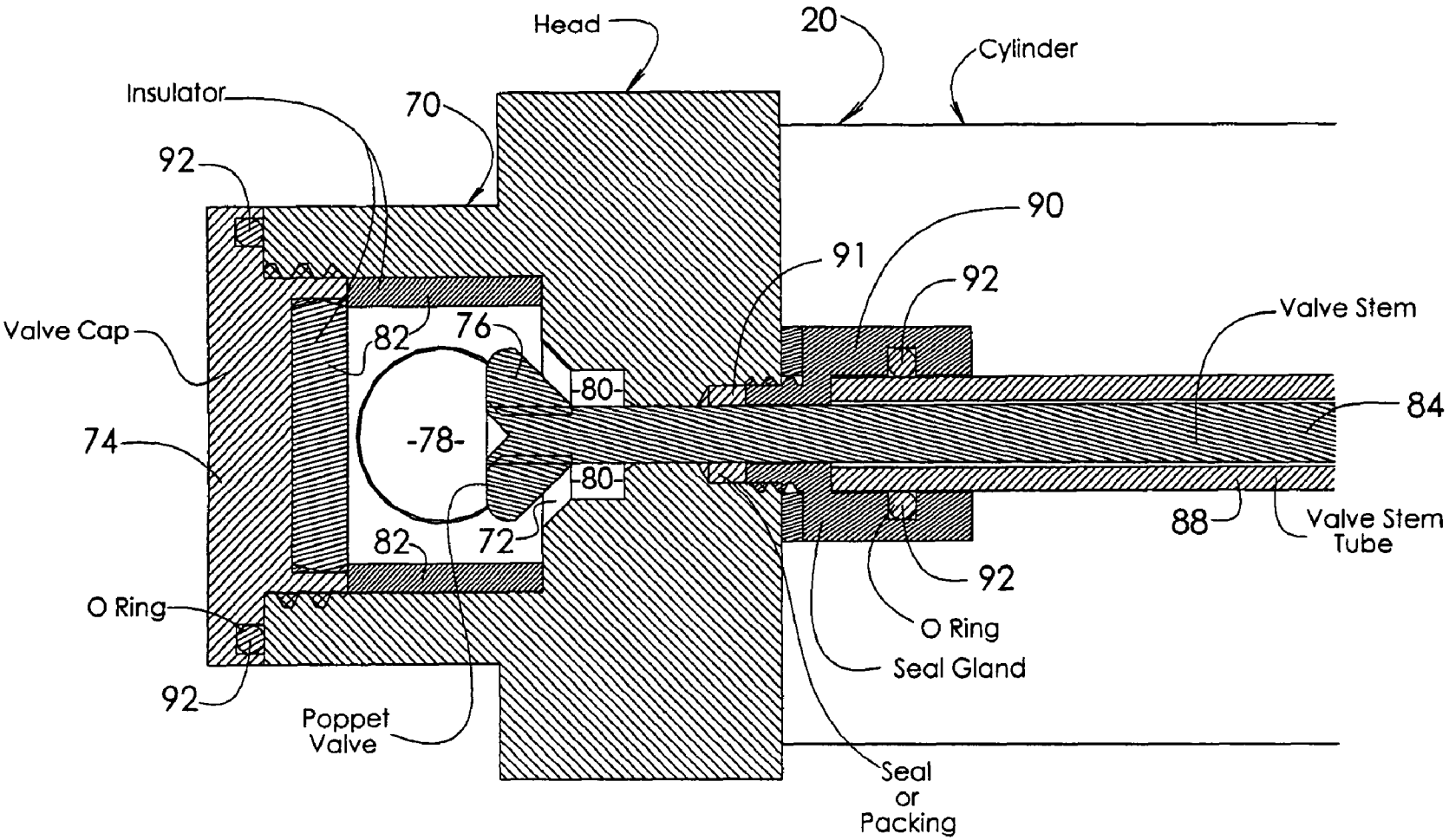
FIG. 6 is an isolated view, shown in cross-section, taken from the area indicated as 6 in FIG. 4, showing an intake valve at one of the cylinders in an open position to thereby allow injection of low pressure steam or gas into the top of the cylinder.
Figure 7:
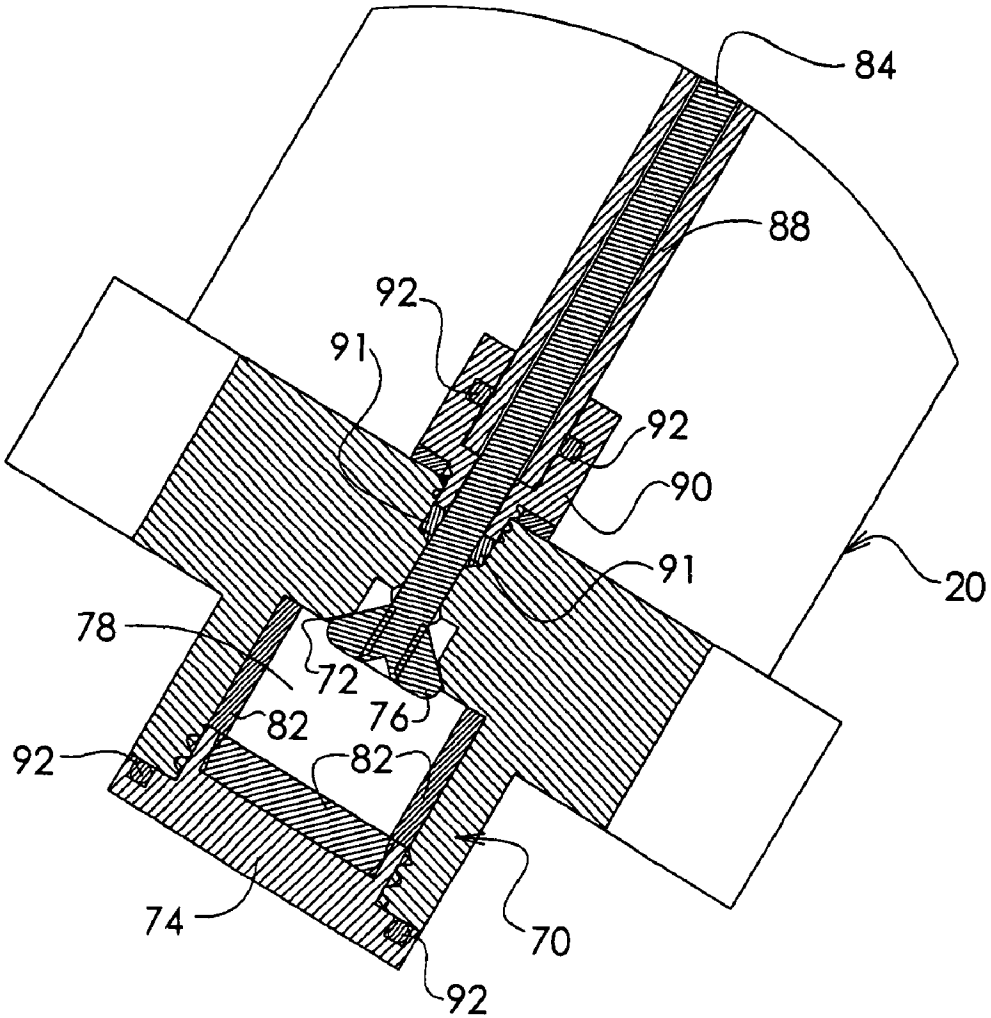
FIG. 7 is an isolated view, shown in cross-section, showing the intake valve of FIG. 6 in a closed position.

The steam injection valve assembly is shown in FIGS. 4-7. Referring to FIGS. 4, 6 and 7, a valve head 70 is located at the top of each cylinder. The valve head includes a valve seat 72 and a valve cap 74. A poppet valve 76 moves in relation to the valve seat 72, between an open position (see FIG. 6) and a closed position (see FIG. 7). Steam from the manifold 18 is directed into a valve chamber 78 within the valve head 70 and, when the poppet valve 76 is opened, the steam is injected through a port 80 and into the top of the cylinder 20. The valve chamber 78 is surrounded by an insulating material 82 to maintain the temperature of the steam within the chamber 78 when the valve 76 is closed. An elongate valve stem 84 extends from the poppet valve 76 inwardly towards a cam follower guide ring 86, as seen in FIGS. 4-5B. Referring to FIG. 4, it is seen that the valve stems 84 are arranged in the same radial configuration as the cylinders 20, with the valve stems 84 extending from the valve heads 70 at the top of the cylinders and inwardly to the cam follower guide ring 86. The valve stems 84 each extend through a valve stem tube 88 that is fitted to a seal gland 90 at the base of the valve head 70. A seal packing 91 and an O-ring 92 help to discourage escape of the steam from the valve head 70. An opposite inboard end of the valve stem tube 88 is fitted to a attachment tube 94 that extends into the cam follower guide ring 86. Cam followers 96 fitted to the end of each valve stem 84 are positioned to extend radially inward into an area 87 within the cam follower guide ring 86 at equally spaced intervals relative to the inner circumference of the guide ring. The cam followers 96 are urged inwardly towards the area within the guide ring by return springs 97 within the respective attachment tubes 94.

A ball bearing cam roller 100 is connected to the top of the spider bearing and/or a crank throw linked to the crankshaft. The cam roller 100 orbits about a circular path within the interior area 87 surrounded by the cam follower guide ring 86. A cam counter-balance weight 102 stabilizes movement of the cam roller 100 as it moves in the eccentric path within the cam follower guide ring 86. The cam roller 100 is specifically sized, structured and disposed for contacting the cam followers 96 on the ends of the valve stems 84. More particularly, as the cam roller 100 moves about the orbital path, it is in contact, at all times with at least one cam follower 96. Movement of the pistons 50 to drive the spider bearing 60 and the crankshaft 24 serves to also move the cam roller 100 in its circular path. As the cam roller 100 contacts each cam follower 96, the associated valve stem 84 is urged axially outward to open the respective poppet valve 76, thereby injecting steam into the associated cylinder 20. As previously noted, the cam roller 100 is always in contact with at least one cam follower 96, so that at any given moment, steam is being injected into at least one cylinder. As the cam roller 100 moves away from one cam follower 96, it simultaneously contacts the next cam follower 96, so that there is an overlap period of steam injection into two adjacent cylinders.

Figure 8A:
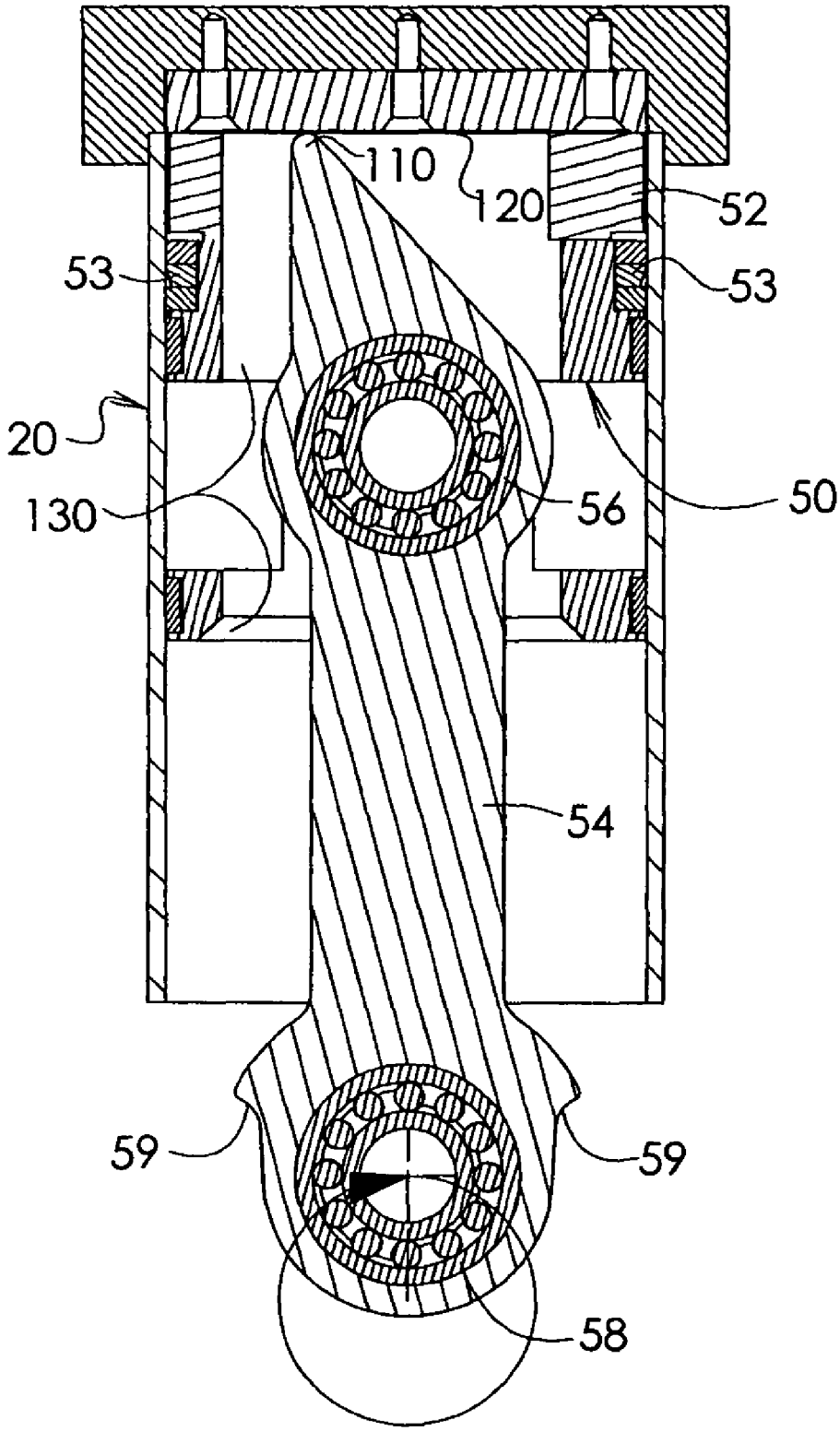
FIGS. 8A-8D illustrate reciprocating movement of a piston within a cylinder from a top dead center position through an exhaust stroke.
Figure 8B:
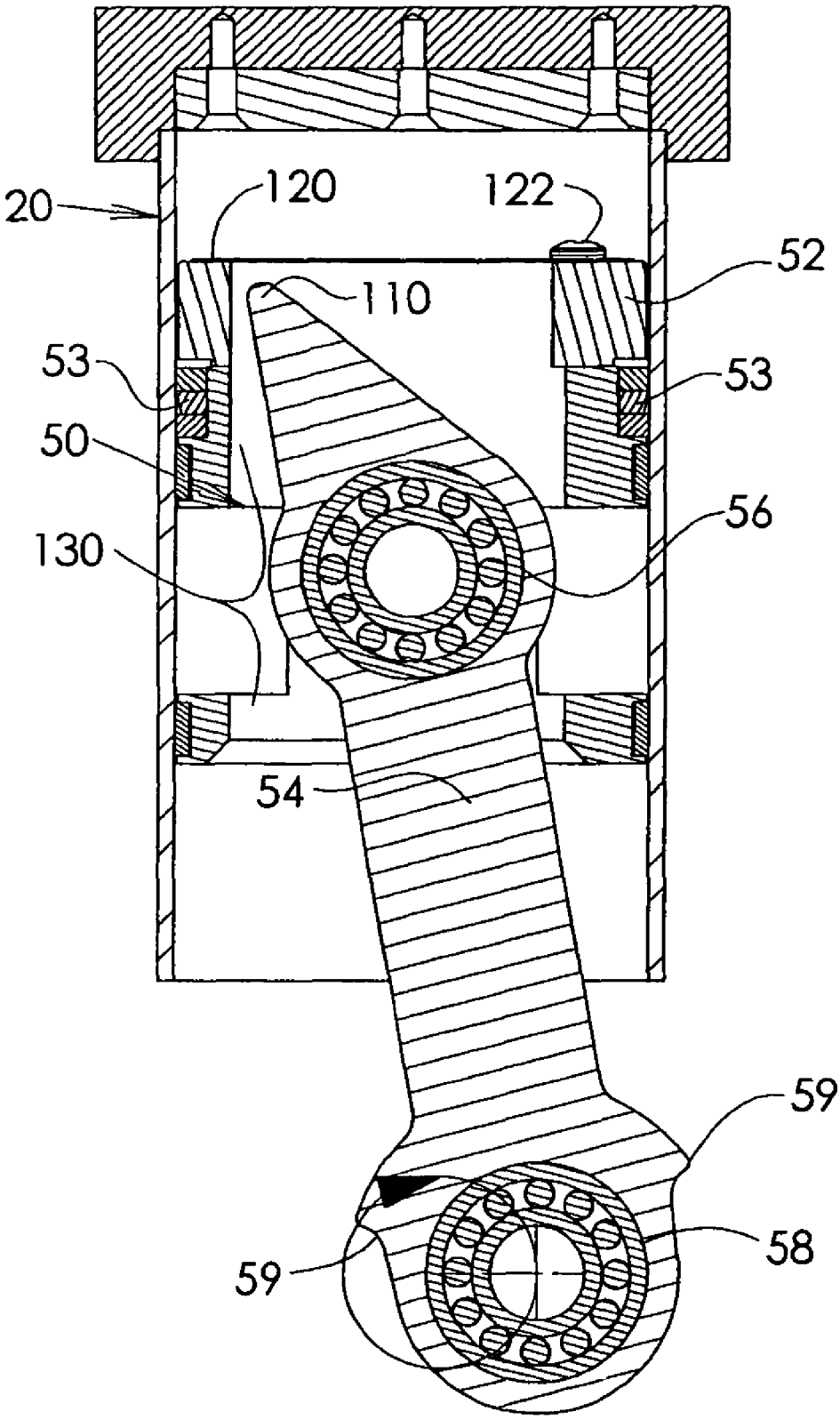
Figure 8C:
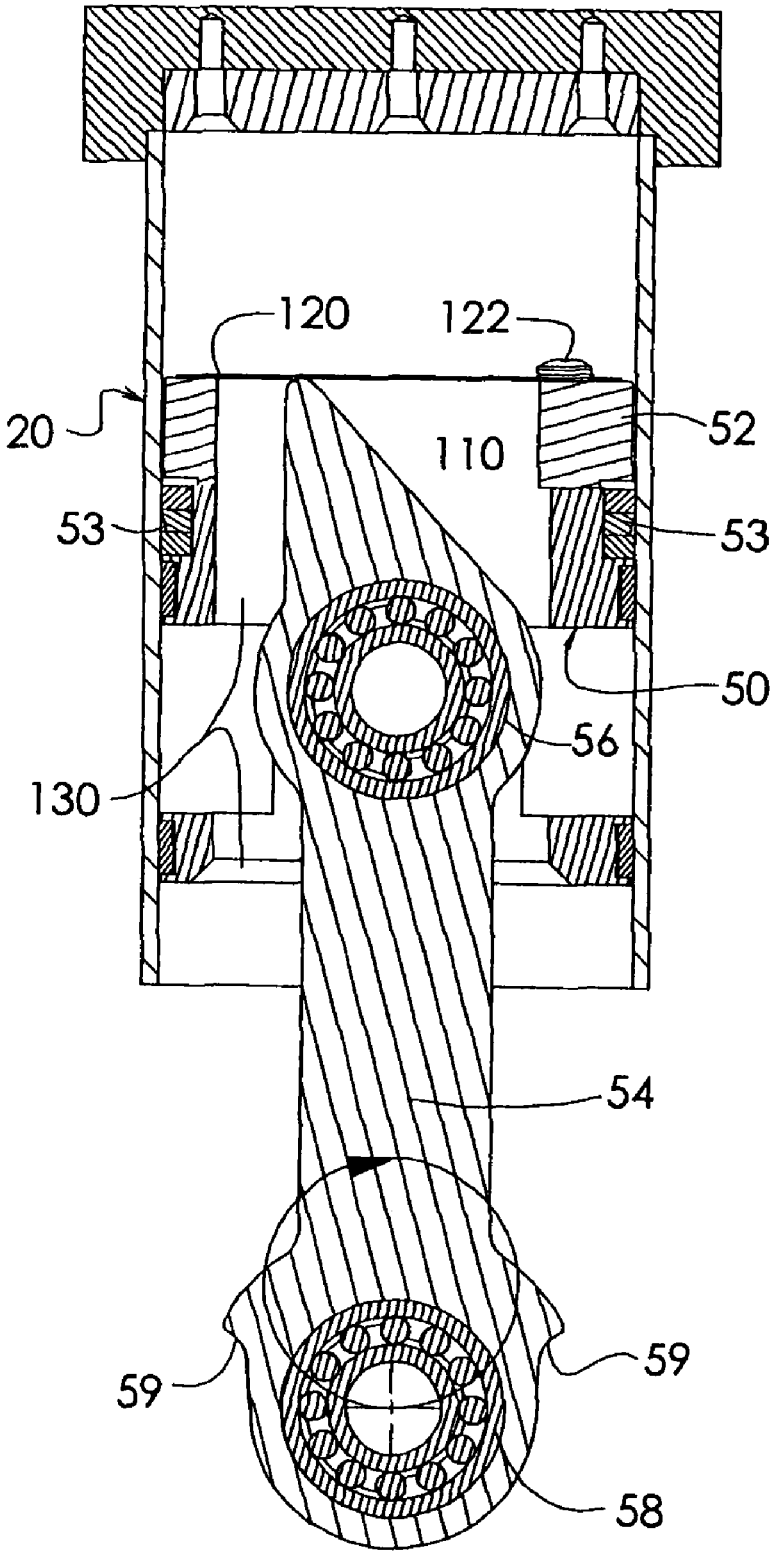
Figure 8D:
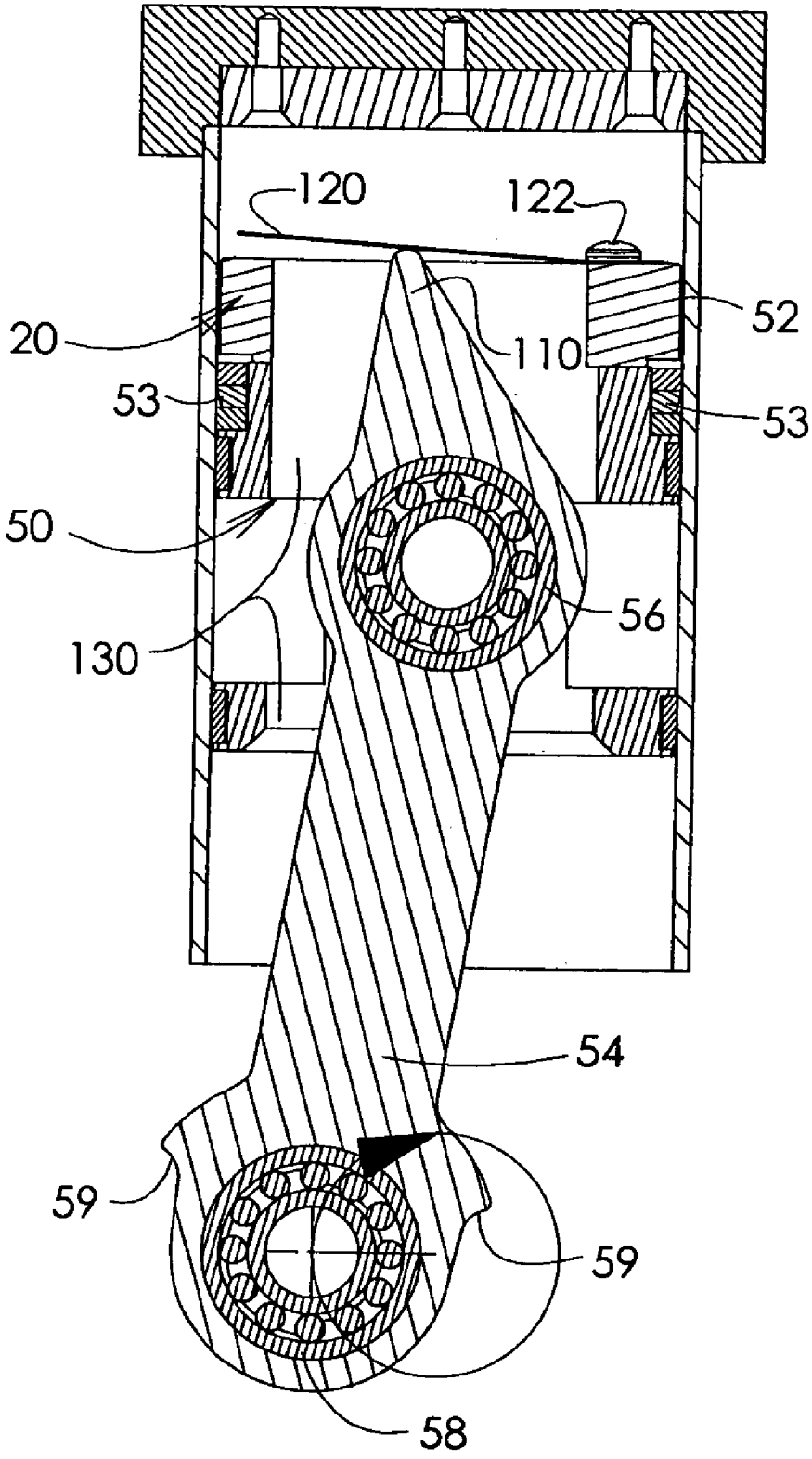
Figure 9:
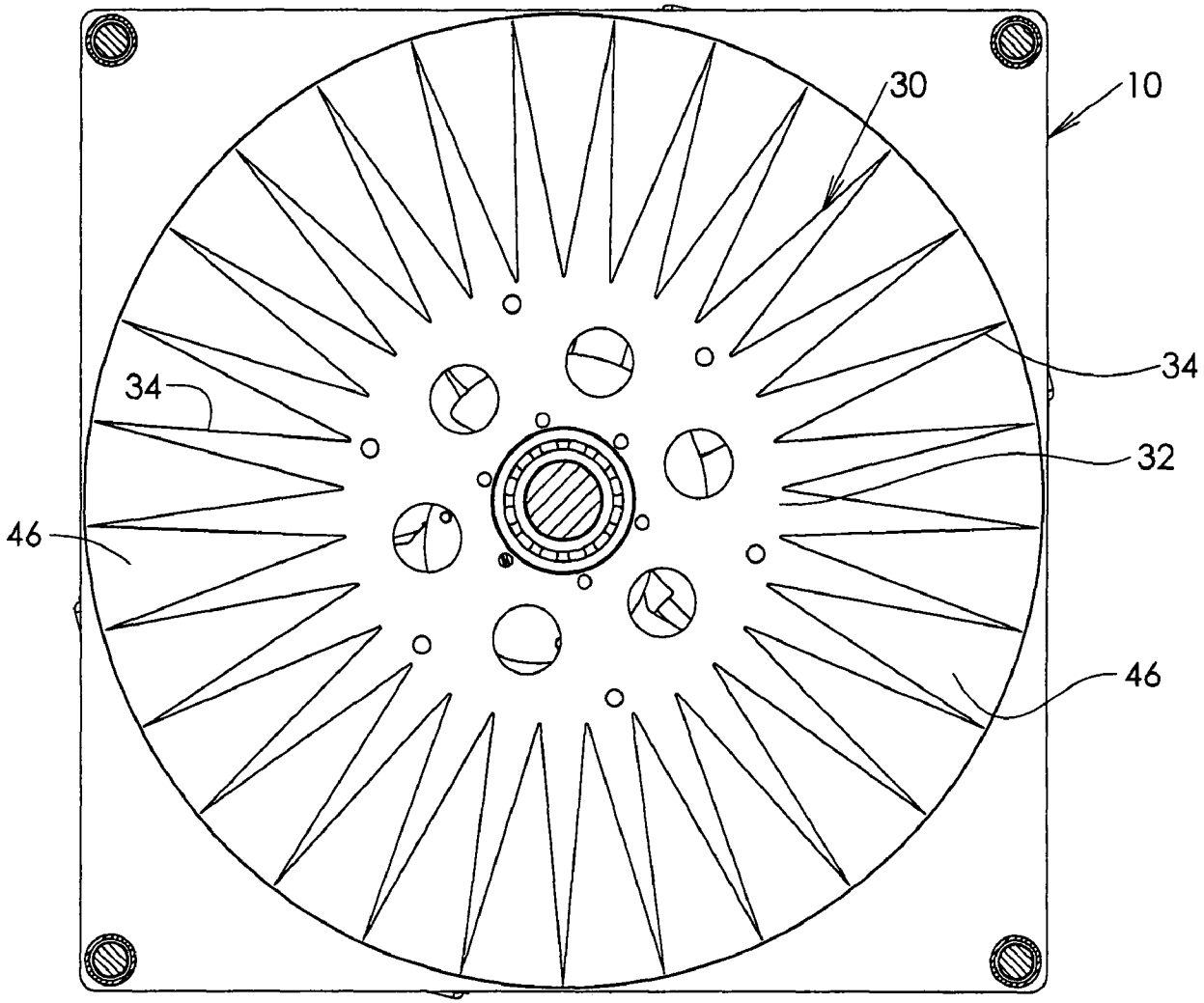
FIG. 9 is a top plan view, in partial cross-section, taken along the plane of a line indicated as 9-9 in FIG. 1.
Figure 10:
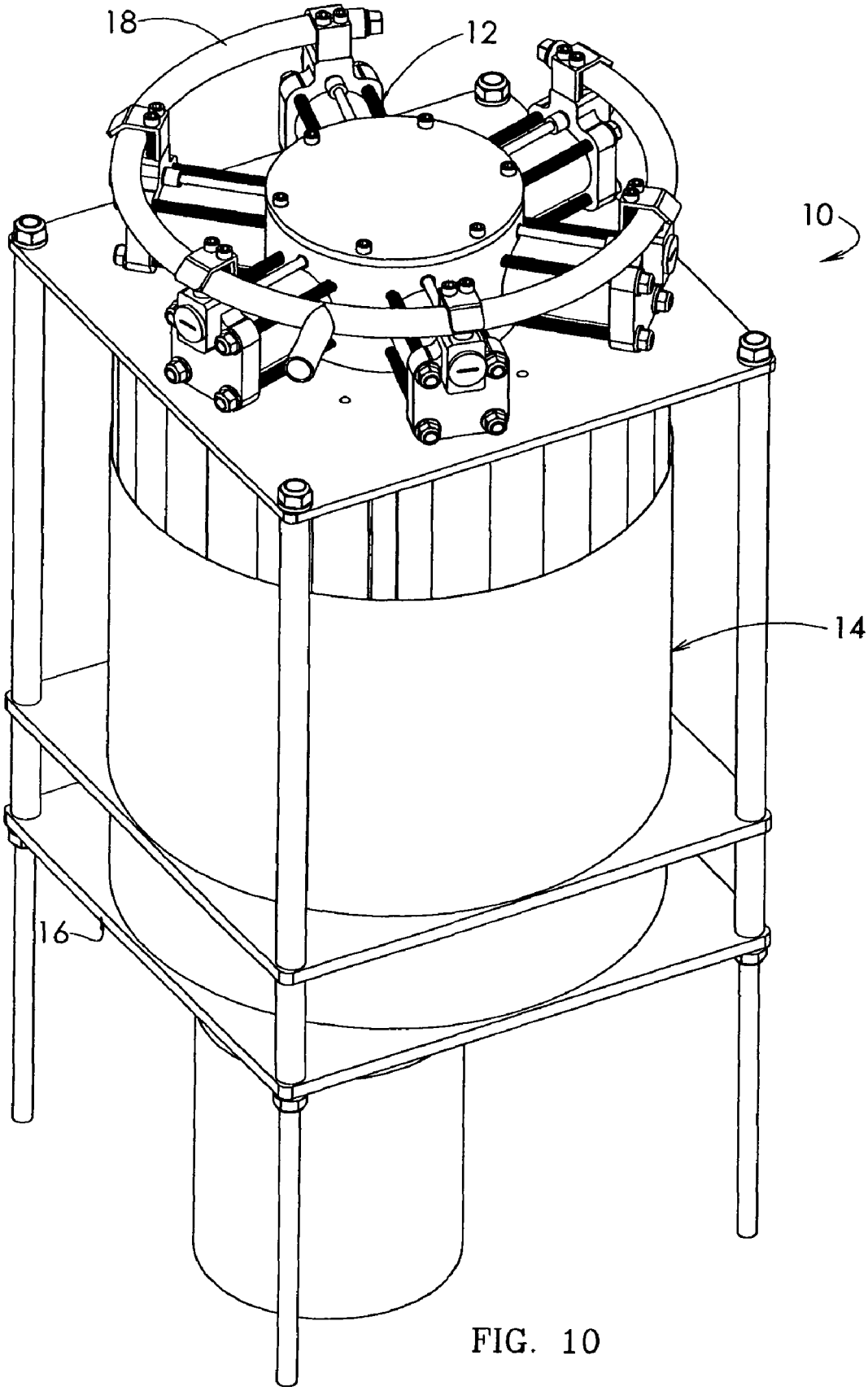
FIG. 10, is a perspective view of the exterior of the waste heat engine.

Referring to FIGS. 8A-8D, each piston assembly 50 within a respective cylinder 20 includes piston head 52 with a seal 53 that engages the inner wall surfaces of the cylinder. As the connecting rod 54 is angularly displaced during the exhaust stroke (see FIG. 8D), a valve lifter 110 on the top end of the connecting rod 54, defined by a generally triangular formation with an apex, hits an exhaust reed valve 120 on the top of the piston head 52. The valve lifter 110 urges the exhaust reed valve 120 from a relaxed position to a raised position, against the force of the spring action of the reed valve flap which is secured at one end by fastener 122 to the piston head 52. With the reed valve flap 120 in the open position, as seen in FIG. 8D, the low pressure steam in the upper portion of the cylinder is released through ports 130 formed through the piston head 52, allowing the steam to exhaust into a condenser chamber 32 of the engine 10 as the piston 50 returns to the top dead center position.

Driven rotation of the crankshaft 24, by forced movement of the pistons 50 within the cylinders 20, serves to operate an alternator 140 (or other electric power generator device) via a belt drive or similar linkage between the crankshaft 24 and the alternator 140. Accordingly, operation of the engine 10 serves to generate electric power.

It is particularly desirable that engine be self-starting. In one preferred embodiment, the radial arrangement of cylinders 20 includes a total of six cylinders, as seen in FIG. 3. The radial arrangement of six cylinders is particularly beneficial for self-starting and allows for two adjacently positioned cylinders to have their intake valves open during an overlap period so that, at any given moment, two pistons are under force of steam pressure, in a downward power stroke to drive movement of the crank disk and rotation of the crankshaft.

While the present invention has been shown and described in accordance with a preferred and practical embodiment, it is recognized that departures from the instant disclosure are fully contemplated within the spirit and scope of the invention as defined in the claims which follow.

What is claimed is:

1. An engine comprising:

a plurality of cylinders arranged in a radial configuration surrounding a central area, and each of said cylinders having a reciprocating piston assembly that is operably moveable through a downward power stroke and an upward returning exhaust stroke, and each piston assembly including a piston moveably disposed within the cylinder and a connecting rod pivotally linked at a first end to said piston and extending from the cylinder and terminating at an opposite second end within the central area;

a crankshaft extending axially through said engine along a longitudinal central rotational axis and including an upper end portion and a lower end portion and said crankshaft being rotatable about said central longitudinal axis;

a crank disk drivingly linked to the upper end portion of the crankshaft and moveable about a central pivot axis of said crank disk that is offset relative to the central rotational axis of the crankshaft so that said crank disk moves in an orbital motion about said central rotational axis as the crankshaft rotates;

a steam distribution assembly including a manifold for receiving a supply of steam and a plurality of steam inlet valve assemblies connected to said manifold for controllably injecting pressurized steam into the cylinders, and each of said plurality of steam inlet valve assemblies including a steam inlet valve at each of said plurality of said cylinders, and said stem inlet valve at each cylinder including a valve member operable between an open position and a closed position relative to a valve seat, and an inlet port extending between the valve seat and an interior of the cylinder above the piston, and each of said steam inlet valves further including a valve stem extending from the valve member to an inboard end, and said inboard and having a spring urged cam follower fitted thereto;

a cam roller moveable about a circular path upon rotation of said crank disk and the crankshaft to sequentially engage the spring urged cam followers on the inboard ends of the valve stems and momentarily urge the valve member away from the valve seat, thereby opening the inlet valve and allowing injection of the steam into the cylinder in order to force the piston through the downward power stroke and move the crank disk in the orbital motion, thereby rotating the crankshaft;

a reed valve flap fastened to a top of the piston in each of said plurality of cylinders and defining an exhaust valve, and said reed valve flap being moveable between a closed position against the top of the piston and an open position defined by said reed valve flap at least partially lifted away from the top of the piston;

a valve lifter on each of said connecting rods, said valve lifter being structured and disposed to engage said reed valve flap as said piston approaches a top of the upward returning exhaust stroke, to thereby lift and open said reed valve flap and allow steam within a top portion of the cylinder to exhaust through the cylinder and into the central area;

a condenser including a condenser chamber communicating with the central area for receiving the exhaust steam;

a blower structured and disposed to direct a cooling airflow over an exterior surface of the condenser, thereby condensing the steam within the condenser into liquid;

a pump operably driven by rotation of said crankshaft for pumping the liquid from the condenser to an external steam generating source; and an electric power generator device operably linked to the crankshaft and operated by rotation of the crankshaft to thereby produce electric power.

2. The engine as recited in claim 1 further comprising:

ear members protruding from opposite sides of each of said connecting rods on said opposite second end;

restrictor pins on said crank disk for engaging said ear members on the second end of the connecting rods for limiting angular deflection of each of said connecting rods during movement of said reciprocating piston assembly through the downward power stroke and the upward returning exhaust stroke.

3. The engine as recited in claim 1 further comprising;

a cam follower guide ring surrounding the central area and being structured and disposed for holding the spring urged cam followers in a radially spaced arrangement about the central area.

4. The engine as recited in claim 1 wherein said valve lifter includes a generally triangular formation on said first end of each of said connecting rods, and said generally triangular formation including an apex for engaging the reed valve flap and moving the reed valve flap to the open position as said piston approaches a top of the upward returning exhaust stroke.

* * * * *